US005359501A

United States Patent [19]

Stevens

[11] Patent Number: 5,359,501

[45] Date of Patent: Oct. 25, 1994

[54] SAFETY LIGHT BELT WITH ROTATABLE LIGHT SWITCH

[76] Inventor: Katrine B. Stevens, 5 Pirates Lane, Unit No. 5, Gloucester, Mass. 01930

[21] Appl. No.: 197,721

[22] Filed: Feb. 17, 1994

[51] Int. Cl.[5] ..... F21L 15/02; F21L 15/08

[52] U.S. Cl. ..... 362/108; 362/197; 362/802

[58] Field of Search ..... 362/103, 108, 157, 190, 362/191, 197, 198, 199, 200, 208, 802

[56] References Cited

U.S. PATENT DOCUMENTS

| | | | |
|---|---|---|---|
| 4,400,763 | 8/1983 | Kribs et al. | 362/103 |
| 4,967,323 | 10/1990 | Johnson et al. | 362/103 |
| 4,974,130 | 11/1990 | Friedman | 362/108 |
| 5,045,979 | 9/1991 | Stevens | 362/103 |
| 5,183,324 | 2/1993 | Thomas | 362/108 |
| 5,255,168 | 10/1993 | Stevens | 362/103 |

*Primary Examiner*—Richard R. Cole
*Attorney, Agent, or Firm*—John P. McGonagle

[57] ABSTRACT

A belt having a holder attached centrally to the belt, and a light housing attached to the holder. The holder contains a switch adjacent to the light housing such that the rotation of the light housing away from the holder causes the switch to close lighting the bulb. The light housing rotates around a flex strip and is guided and held in position by a ridged adjustment band which is fixed to the holder and slidably attached to the light housing. The light housing contains a light socket with a light bulb. The socket is attached to a truncated conical reflective surface which is disposed within a truncated conical shaped shell forming a light housing. The light switch is electrically connected to the switch and to batteries contained within the holder. The switching safety light is switched on and off by the positioning of the light housing relative to the holder.

10 Claims, 5 Drawing Sheets

SAFETY LIGHT BELT WITH ROTATABLE LIGHT SWITCH

BACKGROUND OF THE INVENTION

This invention relates to lighting of the body attached type, and more particularly to a belt with a safety light that may be switched on and off when a light housing is rotated.

Poor visibility is a serious problem at night for pedestrians, outdoor workers, and outdoor exercisers, such as joggers and the like. The difficulty of maneuvering oneself safely on foot on a roadway, field or yard is well known to walkers, joggers, police officers, firefighters, construction workers, railroad workers, and maintenance persons, especially if the person is carrying something or working with their hands.

There have been many attempts to increase pedestrian visibility such as brightly colored and/or reflective clothing. However, little has been done to provide visibility for the pedestrian other than hand-held flashlights. These are impractical, difficult to turn on in the dark and inconvenient for those wishing to keep their hands free for other tasks.

Various patents have been issued which attempt solutions to the above problems. Included among these are Applicant's U.S. Pat. No. 5,049,979, issued on Sep. 3, 1991 (hereinafter referred to as the '979 patent). The safety light belt disclosed in the '979 patent provides a belt with a light holder mounted on the front thereof. A small light, such as a miniature flashlight, is mounted therein. The holder is so constructed that the light is aimed downward and forward of the belt wearer. Applicant's U.S. Pat. No. 5,255,168, issued on Oct. 19, 1993 (hereinafter referred to as the '168 patent), disclosed an improvement on her original safety light belt. The safety light belt of the '168 patent provides a belt with an adjustable light holder mounted on the front thereof. A small light is mounted therein. The holder is so constructed that the light may be forwardly aimed horizontally or downwardly of the belt wearer in discrete steps.

SUMMARY OF THE INVENTION

The present invention provides a safety light belt with rotatable light switch. As such, the general purpose of the present invention which will be described subsequently in detail, is to provide a light, attached to the person, that is adjustably aimed in front of the wearer. The light can be adjusted forwardly and/or upwardly on a work piece or work area and incorporates an automatic method for turning the light on and off.

The present invention is a further improvement on the '979 and '168 patents. The present invention is automatically turned on when the invention's light housing is rotated. The present invention also contains a substantially greater number of potential aiming positions for the light housing. The present invention also eliminates some of the bulkiness of the '168 patent.

This invention incorporates a flex strip about which the light housing rotates and an adjustment band which provides many more possible angled positions of the light housing. The present invention can be adjusted to the appropriate user defined light angle. In addition, the light housing does not need to be urged from the holder and urged back against the holder but merely rotated about the flex strip.

This invention has a switch built into the holder that automatically turns the light belt on by rotation of the light housing. The switch is located adjacent to the light housing such that the rotation of the light housing away from the holder causes the switch to close lighting the bulb. A user does not need to try to locate a switch in the dark but merely locate the light housing and urge it away from the holder. This makes the present invention easier to turn on in the dark.

Most prior art light belts have battery replacement methods which require the removal of the entire holder top. The present invention only requires the removal of two battery access caps for replacement of batteries thereby simplifying the power means replacement process.

It is an object of this version of the invention to provide a safety light belt that may be worn, in one embodiment, around the waist. The light would shine on the ground in front of the person wearing the light to prevent injury while walking at night. The light would also alert motorists to pedestrians. The light would also allow the person wearing it to carry objects or tools in the hands and still light the path.

Another object of this version of the invention is to have the light adjustable such that the area lit can vary as a distance away from the person. The light is adjustable and can be rotated in a vertical plane thereby lighting an area closer to or farther away from the person wearing the belt depending on the persons need.

Another object of this version of the invention is to provide a light that is easy to turn on should a user suddenly find themselves in the dark.

To attain this, the present invention provides a belt with a holder and an adjustable light housing mounted on the front thereof. The holder also has a flexible rain shield attached to the front such that the safety light belt can be used in rainy weather. The light has a switch internally located in the holder which automatically turns on when the light housing is rotated from a substantially vertical first position about the holder to a predetermined angle towards horizontal. This rotation allows a switch lever to rotate and close the on/off switch. The light is automatically turned off by rotating the light housing back into the substantially vertical first position. An illumination means or bulb is mounted within the light housing. The light housing is so constructed that the light may be forwardly and downwardly aimed, adjusted and held in place to light a walking path. The light may also be forwardly and upwardly aimed, adjusted and held in place to illuminate an object above the head of the light belt wearer.

These together with other objects of this version of the invention, along with various features of novelty which characterize this version of the invention, are pointed out with particularity in the claims annexed hereto and forming a part of this disclosure. For a better understanding of this version of the invention, its operating advantages and the specific objects attained by its uses, reference should be had to the accompanying drawings and descriptive matter in which there is illustrated a preferred embodiment of this version of the invention.

DETAILED DESCRIPTION OF THE INVENTION

Figure 1A:
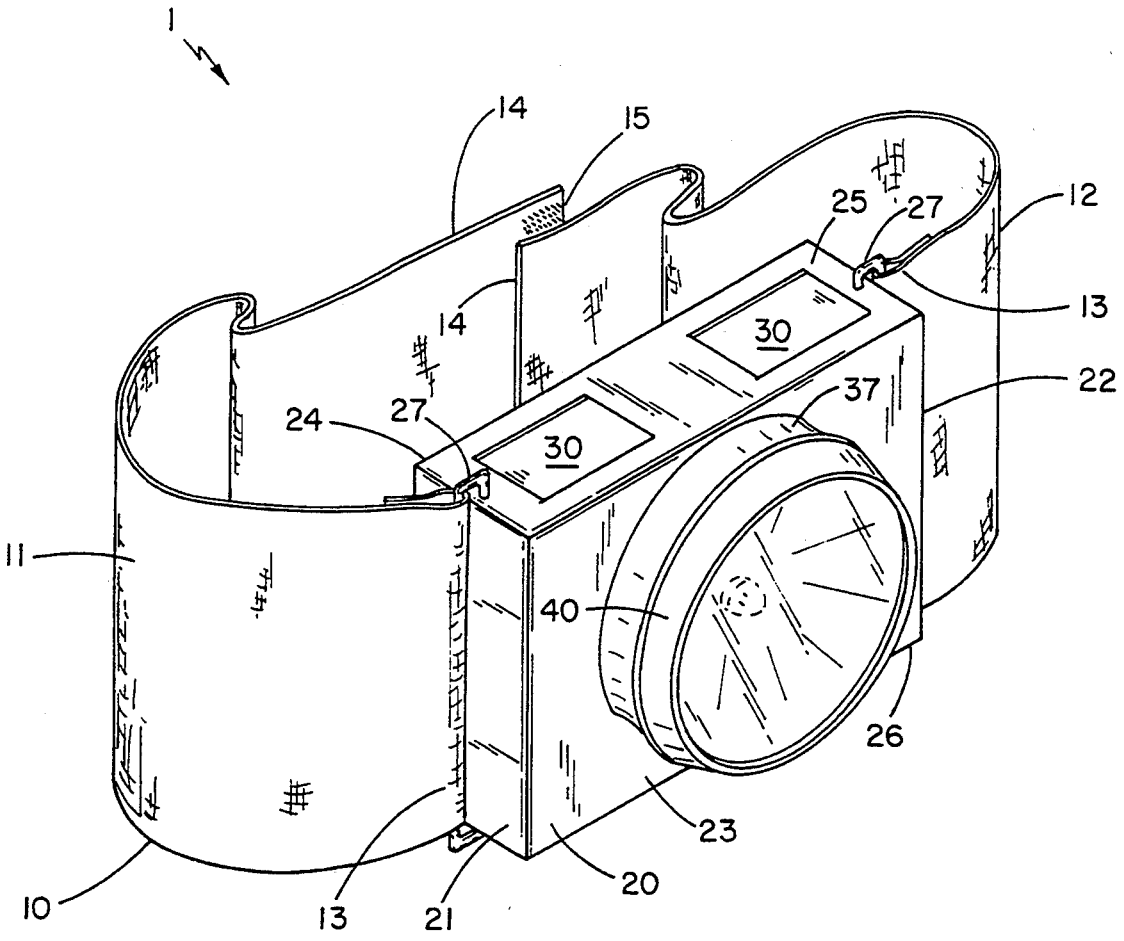
FIG. 1A is a front perspective view of a safety light belt incorporating the features of the present invention, in a closed unlighted position.

Referring to the drawings in detail wherein like elements are indicated by like numerals, there is shown an embodiment of the invention 1 incorporating a safety light belt with a rotatable light switch. The invention 1 is comprised of a belt 10, holder 20 attached centrally to the belt 10, and a light housing 40 attached to the holder 20.

The holder 20 is generally hollow, has a generally rectangular shape and a quadrilaterally shaped cross-section. The holder 20 has a right side 21, and a left side 22, a front 23, back 24, top 25, and a bottom 26. The holder front 23 has a circular cutout 28 substantially centered on said front. The holder's right and left sides 21, 22 have rectangular attachment "rings" 27 attached thereto. The top 25 of the holder 20 has a pair of battery access caps 30 which are removably attached and allow insertion of a power means, in this case, a battery 35, under each cap 30, into the interior 29 of the holder 20.

The belt 10 is comprised of two sections 11, 12. Each section has two ends, a first end 13 attached to a holder ring 27 and a second end 14 terminating in connection means 15 for joining of the two belt sections 11, 12. In this embodiment of the invention 1, the connection means 15 are comprised of hook and pile fastener arrangements. Alternative embodiments could have buckle arrangements, buttons arrangements, slide ring arrangements, or even simple tie arrangements. Alternative embodiments could also have adjustment means wherein the effective length of one or both belt sections could be lengthened or shortened. The belt 10 is intended to be fastened around a user's waist (not shown). The holder 20 is intended to be positioned at the wearer's stomach area (not shown).

The light housing 40 is attached to the holder bottom front edge 26-23 by a flex strip 56, and is substantially centered on the holder front 23 in the holder front circular cutout 28. The light housing 40 has a conventional truncated conical shaped shell 50 with a circular back face 51 and a front face 52 with a circular transparent element 53 attached thereto. The light housing 40 also has a truncated conical reflective surface 54 within with a conventional light socket 60 centrally attached. An illumination means, in this embodiment a conventional bulb 61, is housed in the light socket 60.

Electrical wiring 65 is attached to the socket 60 and extends from the socket 60 through housing back face 51 to and attached to an on/off switch 70 which is mounted to the interior 29 of the holder 20. The light bulb 61 is thereby electrically connected to the switch 70. Electrical wiring 65 further attaches the on/off switch 70 to the power means, i.e., the batteries 35. A standard bulb lighting electrical circuit is thereby established. The on/off switch 70 is triggered by a spring-loaded switch lever 71.

An adjustment band 42 protrudes through the back face 51 of the light housing 40 and is slidably adjacent to a free end 44 of an adjustment index 43. The adjustment index 43 is coplanar to the back face 51. The adjustment band 42 has an elongated rectangular shape with a top surface 45, bottom surface 46, and two sides 47. The band 42 is preferably manufactured from a flexible material. The adjustment band 42 has a first end or band end 48 fixedly attached to the interior of the holder 20 in a position above the on/off switch 70 in the holder front circular cutout 28. A second end or band stop 49 is free floating and located between the reflective surface 54 and the truncated conical shaped shell 50. The adjustment band 42 has a longitudinal axis running from the band end 48 to the band stop 49. The adjustment band 42 has a plurality of ridges 41 on the bottom surface perpendicular to the longitudinal axis. The ridges 41 slide across the free end 44 of the adjustment index 43 as the light housing 40 is rotated. The interface between the ridges 41 and the free end 44 of the adjustment index 43, guides the rotation of the light housing 40 and holds the angular position of the light housing 40 relative to the holder 20.

The rotational positions of the light housing 40 occur between the substantially vertical first position and the approximately forty five degree angle to horizontal, or second position. The light housing 40 reaches the maximum rotational position, or second position, when the band stop 49 contacts the inside of the back face 51. The light housing 40 is then restrained from further rotation by the contact of the band stop 49 and the interior of the back face 51.

A generally circular shield 37 is attached about the holder front central cutout 28. The shield 37 extends forward away from the holder 20 over a portion of the light housing 40. The shield 37 may be augmented with a rain shield 38 about a portion of the shield 37 to provide additional protection for the on/off switch 70 and the adjustment band 42 from rain and objects falling from above the invention 1. The rain shield 38 is attached to said holder front 23 near to the top 25. See FIG. 1B.

The illumination means or bulb 61 is switched on and off by the rotation of the light housing 40 relative to the holder 20. The rotation of the light housing 40 from the first or closed position, (see FIGS. 1 and 3), to the second or open position, (see FIGS. 2 and 4), allows the spring loaded switch lever 71 to rotate to the position closing the on/off switch 70 and lighting the bulb 61.

Figure 1B:
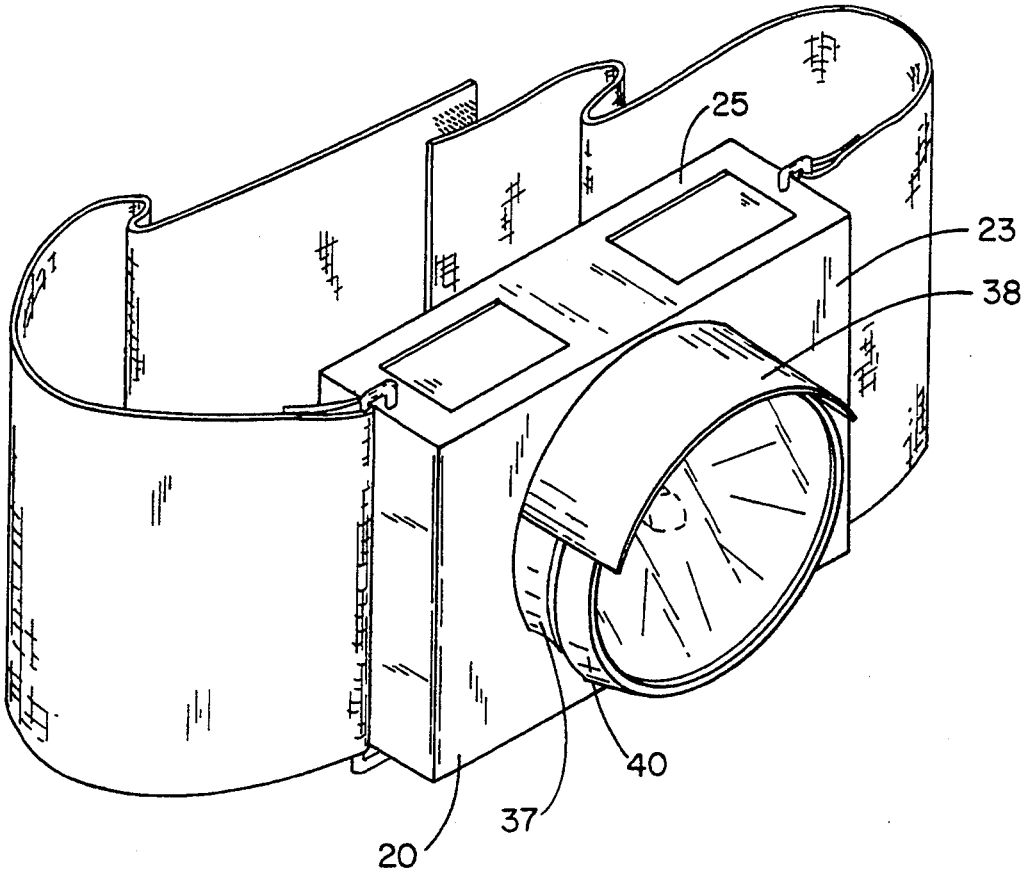
Fig. 1B is a view of the invention illustrated in FIG. 1A with a rain shield.
Figure 3:
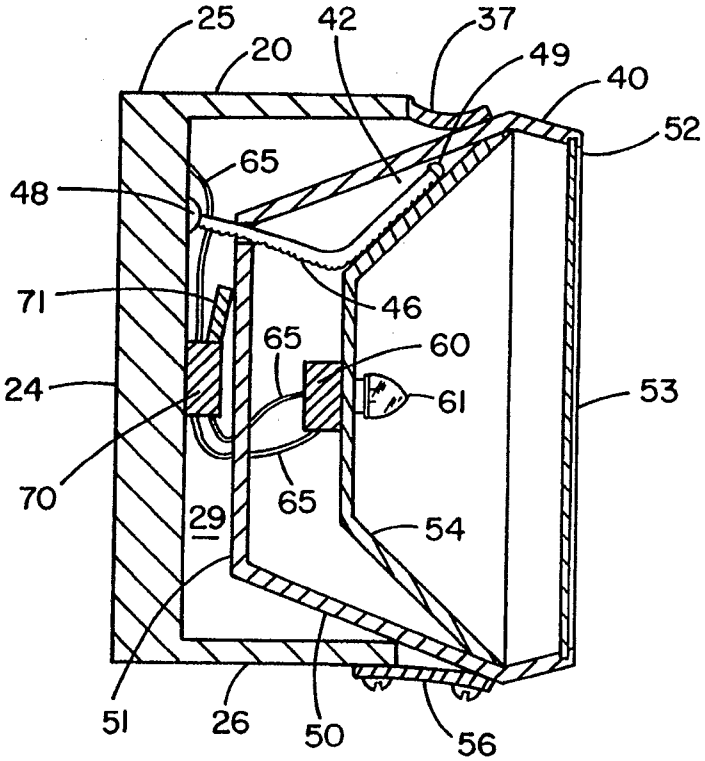
FIG. 3 is a cross-sectional view of the invention's holder and housing in the position corresponding to the view of FIG. 1A.
Figure 6:
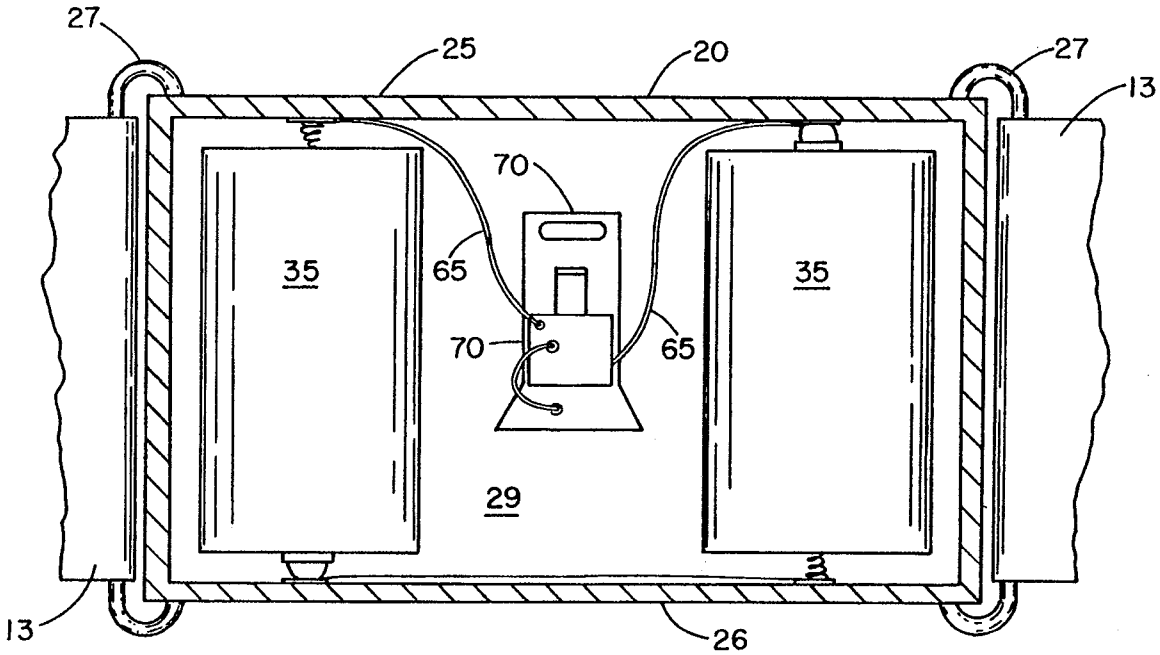
FIG. 6 is a sectional back plan view of the invention holder.
Figure 5:
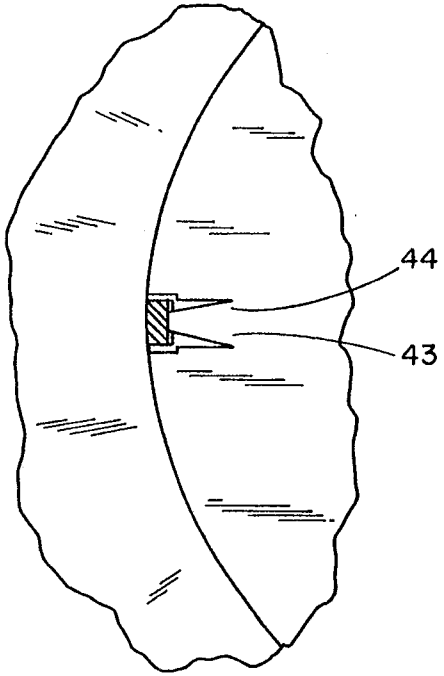
FIG. 5 is a cross-sectional detailed view of the invention along the line 5—5 in FIG. 4.

As shown in FIGS. 1A and 3, the light housing 40 and switch lever 71 are in the first position (switch open position). The back face 51 is adjacent to and biasing the switch lever 71 of the on/off switch 70 to the substantially vertical position. In this position, the on/off switch 70 is open and the bulb 61 is in an unlit condition. The switch lever 71 is spring loaded to rotate to a substantially forty five degree angle from the substantially vertical position.

Figure 2:
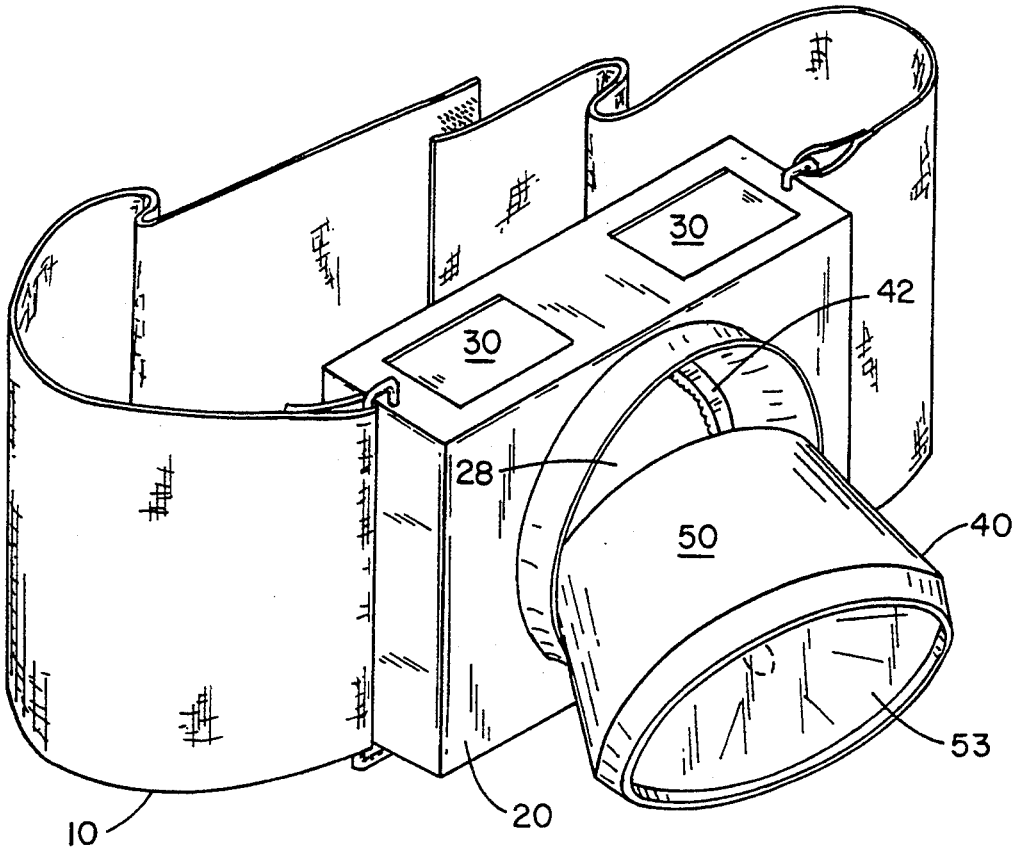
FIG. 2 is a view of the invention of FIG. 1A in an open lighted position.
Figure 4:
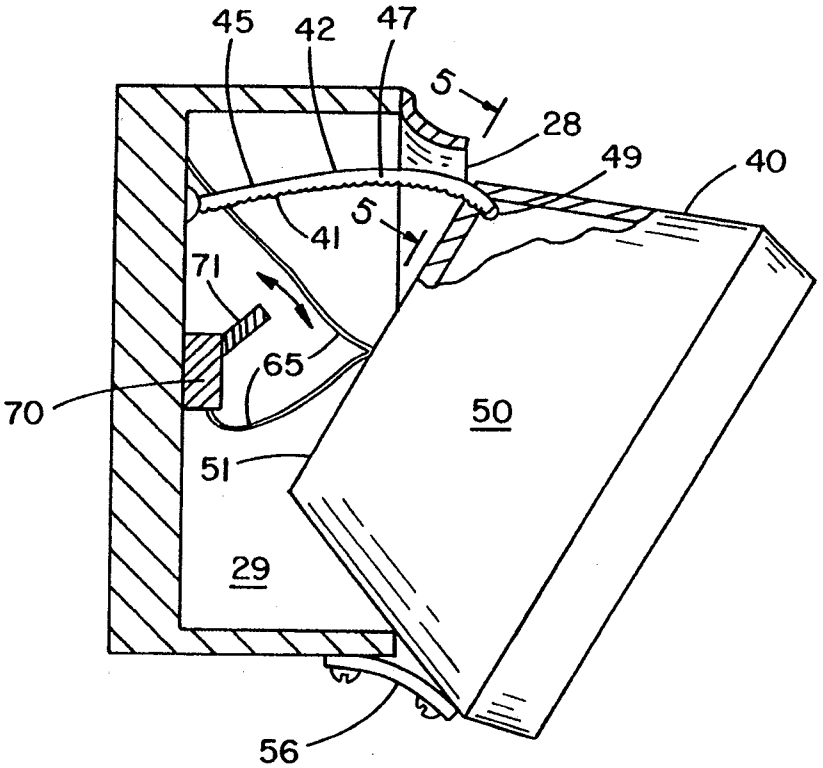
FIG. 4 is a cross-sectional view of the invention's holder and housing in the position corresponding to the view of FIG. 2.

FIGS. 2 and 4 show the light housing 40 and switch lever 71 in a second or on/off switch 50 closed position. In the second position, the light housing 40 is rotated such that the back face 51 moves away from the switch lever 71 around a flexible flex strip 41. The switch lever 71 rotates under the spring loading to a position in which the switch lever 71 closes the on/off switch 70 and powers the wiring 65 which lights the bulb 61. The position occurs when the switch lever 71 is rotated to a predetermined angle away from the substantially vertical position.

Thus by rotating the light housing 40 around the flex strip 41 relative to the holder 20, the bulb 61 can be turned on and off, and the light housing 40 adjusted to a multitude of light emitting positions. The adjustment band 42 provides a guide for rotation and the ridges 41 provide indexed rotational positions. The light housing 40 adjustment positions range from the first substantially vertical position to a second position substantially forty five degrees from the first position. The switching safety light belt user can adjust the light housing 40 to any position between the first position and the second position. The band stop 49 provides a restraint or limit for rotation of the light housing 40 relative to the holder 20.

The switch lever 71 is held in the off position and the switch 70 is open when the light housing 40 is in the substantially vertical first position. Rotation of the light housing 40 away from the switch lever 71 allows the switch lever 71 to rotate, the switch 70 to close and the bulb 61 to light. The light housing 40 can be adjusted and positioned according to the needs of the wearer. The light housing 40 is vertically adjustable so that the light illuminates a variety of user identified downward or upward areas in front of the belt wearer.

It is understood that the above-described embodiment is merely illustrative of the application. Other embodiments may be readily devised by those skilled in the art which will embody the principles of the invention and fall within the spirit and scope thereof.

I claim:

1. A safety light belt worn by a person, comprising:

a holder having a back, a top, a bottom, two sides, a front with a circular cutout substantially centered on said front, and a quadrilaterally shaped cross-section;

two side rings mounted in the holder top and bottom and parallel to said two sides;

a belt comprised of two pieces each having a first end and a second end, each said first end being attached to a separate said side ring;

a light housing having a truncated conical shaped shell with a circular back face and a circular transparent front face and containing a truncated conical reflective surface and an illumination means, said light housing adjustably connected to said holder through said holder front circular cutout and adjustably positioned therein so that said light housing assembly may illuminate an area forwardly, upward, horizontal, or downward from a worn position on a person, said circular back face containing a coplanar adjustment index with an attachment end and a free end said free end located near a top edge of said back face;

an on/off switch having a switch lever for opening and closing said on/off switch fixedly attached and substantially centered within the circular cutout of said holder; and a power supply means contained within the holder and electrically connecting said on/off switch to said illumination means.

2. A safety light belt in accordance with claim 1, wherein said holder is further comprised of:

a flexible flex strip attached near a front edge of said bottom by attachment means;

a flexible attachment band with a top, a bottom, two sides, a band stop end, a band end, a longitudinal axis from said band end to said band stop, a plurality of ridges perpendicular to said longitudinal axis along said bottom from said band end to said band stop, said attachment band end fixedly attached to said holder in said circular cutout;

wherein said attachment band is inserted through the top edge of said back face of said light housing such that said ridges are slidably adjacent to said free end of said adjustment index and said band stop is free floating within said light housing between said truncated conical shaped shell and said reflective surface.

3. A safety light belt in accordance with claim 2, further comprising:

a generally circular shield attached about the holder front central cutout and extending forward away from the holder over a portion of the light housing.

4. A safety light belt in accordance with claim 3, further comprising:

a rain shield attached to said holder front near to the top.

5. A safety light belt in accordance with claim 4, wherein:

said light housing is attached to said flex strip by attachment means at an outer edge of said truncated conical shaped shell and indexed and rotationally guided by said attachment band such that said light housing rotates in relation to said holder from a first substantially vertical position to a second position substantially forty five degrees from horizontal.

6. A safety light belt in accordance with claim 5, wherein:

said switch lever is spring loaded and biased in a substantially vertical first position by said light housing back face where said on/off switch is open and rotates from said vertical position upon rotation of said light housing to close said on/off switch and illuminate said illumination means.

7. A safety light belt in accordance with claim 6, wherein:

said illumination means is a standard light bulb.

8. A light belt in accordance with claim 7, wherein:

said flexible strip has a primarily rectangular shape with a first end and a second end, said first end attached by attachment means to near said front edge of said bottom of said holder and said second end attached by attachment means to said light housing truncated conical shaped shell.

9. A light belt in accordance with claim 8, wherein:

said holder top surface contains a pair of removably attached battery access caps for installation and removal of a power means.

10. A light belt in accordance with claim 9, wherein:

said power means is a pair of batteries.

* * * * *